US007773903B2

(12) United States Patent
Kao

(10) Patent No.: US 7,773,903 B2
(45) Date of Patent: Aug. 10, 2010

(54) MODE-SWITCHING DEVICE OF CONTROL PANEL

(75) Inventor: Chia Hung Kao, Taipei (TW)

(73) Assignee: Teco Image Systems Co., Ltd., Taipei (TW)

( * ) Notice: Subject to any disclaimer, the term of this patent is extended or adjusted under 35 U.S.C. 154(b) by 441 days.

(21) Appl. No.: 11/593,529

(22) Filed: Nov. 7, 2006

(65) Prior Publication Data

US 2008/0124116 A1 May 29, 2008

(30) Foreign Application Priority Data

Jun. 29, 2006 (TW) ..... 95123667 A

(51) Int. Cl.
*G03G 15/00* (2006.01)

(52) U.S. Cl. ..... 399/81; 700/17; 341/23

(58) Field of Classification Search ..... 399/81; 361/679, 681; 700/17, 83; 341/23
See application file for complete search history.

(56) References Cited

U.S. PATENT DOCUMENTS 3,967,369 A * 7/1976 Takano ..... 29/622
4,994,988 A * 2/1991 Yokoi ..... 358/1.13
5,077,551 A * 12/1991 Saitou ..... 345/207
2005/0212792 A1 * 9/2005 Tachikawa et al. ..... 345/211

* cited by examiner

*Primary Examiner*—David P Porta
*Assistant Examiner*—Benjamin Schmitt
(74) *Attorney, Agent, or Firm*—Bacon & Thomas, PLLC

(57) ABSTRACT

A mode-switching device of a control panel is operated to control the operating status of the control panel to be switched between a first operating mode and a second operating mode. The mode-switching device includes a foldable plate, a triggering element and a switch device. The foldable plate includes a rotating shaft and a rotating arm. The rotating arm has a cam adjacent to the connecting portion between the rotating shaft and the rotating arm. The cam has a first arc surface, a second arc surface and a rotating center. A first distance between the first arc surface and the rotating center is less than a second distance between the second arc surface and the rotating center. The triggering element is disposed adjacent to the cam. The switch device is disposed on a control circuit board and under the triggering element.

14 Claims, 7 Drawing Sheets

MODE-SWITCHING DEVICE OF CONTROL PANEL

FIELD OF THE INVENTION

The present invention relates to a control panel, and more particularly to a mode-switching device of a control panel.

BACKGROUND OF THE INVENTION

With increasing power of personal computers, a diversity of peripheral devices can be employed with the personal computers to achieve various purposes. The diverse peripherals, however, occupy lots of space. A multifunction peripheral having multiple functions in one structural unit, for example the functions of a printer, a scanner, a fax machine and/or a copy machine, is thus developed. As a consequence, the processing capability of the multifunction peripheral is increased and the operative space thereof is reduced. Moreover, the assembling process of the multifunction peripheral becomes simpler and simpler. Via a network line, a phone line and a power cable, the multifunction peripheral are well operated.

Generally, most electronic apparatuses have control panels for operating the functions of the electronic apparatuses therevia. Referring to FIG. 1(*a*), a conventional control panel for use in an electronic apparatus is schematically illustrated. The control panel 10 includes a display region 11 and a control region 12. The operating statuses of the electronic apparatus are shown on the display region 11. The control region 12 comprises several alphanumeric keys or numeric keys 13. The lower ends of the keys 13 are electrically connected to a control circuit board (not shown) inside the control panel 10. When one of the keys 13 is depressed down, a corresponding instruction is issued from the control circuit board. In addition, the area of the control panel 10 is limited by the overall volume of the electronic apparatus. Due to the limited area, the number and the arrangement of the keys 13 are insufficient to meet the consumers' requirements. For increasing the capability of operating the functions of the electronic apparatus, the control panel 10 further includes a mode-switching device 14. By operating the mode-switching device 14, the operating statuses of the electronic apparatus are switched among different operating modes. In other words, different instructions are issued from the control circuit board in different operating modes when an identical key 13 is depressed.

Referring to FIG. 1(*b*), a partial enlarged view of the control panel 10 is schematically illustrated. A bump 15 is arranged on the lower edge of the mode-switching device 14. A switch element 16 is accommodated within an indentation of the control panel 10 and corresponding to the bump 15. When the mode-switching device 14 is uplifted, the control panel 10 is operated in a first operating mode. Whereas, when the mode-switching device 14 is closed, the bump 15 will press down the switch element 16 such that the control panel 10 is operated from the first operating mode to a second operating mode.

As known, the procedures of forming the bump 15 and forming an indentation to accommodating the switch element 16 are complicated and not cost-effective. For assuring that the switch element 16 is effectively depressed by the bump 15, a portion of the switch element 16 should be exposed outside the indentation. Therefore, the problems of electrostatic discharge (ESD) and electro-magnetic interference (EMI), which are detrimental to the control circuit board, are generated. Since the mode-switching device 14 is made of plastic material, the mode-switching device 14 is readily raised up if the weight thereof is not sufficient. In addition, a gap between the bump 15 and the switch element 16 may impair the stability and reliability of switching the operating modes.

Therefore, there is a need to provide a mode-switching device of a control panel having increased stability and reliability of switching the operating modes and simplified configurations.

SUMMARY OF THE INVENTION

It is an object of the present invention to provide a mode-switching device of a control panel operated to control the operating status of the control panel to be switched between a first operating mode and a second operating mode, in which different instructions are issued from the control circuit board in different operating modes when an identical key is depressed, thereby reducing the number of keys.

In accordance with an aspect of the present invention, there is provided a mode-switching device of a control panel for use in an electronic apparatus. The mode-switching device is operated to control the operating status of the control panel to be switched between a first operating mode and a second operating mode. The mode-switching device includes a foldable plate, a triggering element and a switch device. The foldable plate includes a rotating shaft and a rotating arm. The rotating arm has a cam adjacent to the connecting portion between the rotating shaft and the rotating arm. The cam has a first arc surface, a second arc surface and a rotating center. A first distance between the first arc surface and the rotating center is less than a second distance between the second arc surface and the rotating center. The triggering element is disposed adjacent to the cam. The switch device is disposed on a control circuit board and under the triggering element.

In an embodiment, the rotating arm of the foldable plate lies flat on a surface of the control panel when the control panel is operated in the first operating mode.

In an embodiment, the cam is separated from the triggering element when the control panel is operated in the first operating mode.

Preferably, the resilient element is a spring.

In an embodiment, the switch device further includes a resilient element.

In an embodiment, the foldable plate is rotated along the rotating shaft in a reverse direction such that the second arc surface of the cam is disengaged from the triggering element, and the switch device is returned to the original position in response to a restoring force of the resilient element, thereby controlling the operating status of the control panel from the second operating mode to the first operating mode.

In an embodiment, the triggering element is disposed under the cam.

In an embodiment, the first arc surface of the cam is arc-shaped.

In an embodiment, the second arc surface of the cam is arc-shaped.

In an embodiment, the cam is an eccentric cam.

In an embodiment, the switch device is a sensor switch.

In an embodiment, the switch device is enclosed by a plastic ring.

Preferably, the electronic apparatus is a fax machine, a telephone, a printer, a scanner, and/or a copy machine, a multifunction peripheral or a remote controller.

In accordance with another aspect of the present invention, there is provided a control panel for use in an electronic apparatus. The control panel includes a control region, a display region and a mode-switching device. The control region includes a plurality of keys. The display region is used for showing the operating status of the electronic apparatus thereon. The mode-switching device comprises a foldable plate, a triggering element and a switch device. The foldable plate is rotated along the rotating shaft such that the second arc surface of the cam is sustained against the triggering element, thereby controlling the operating status of the control panel from a first operating mode to a second operating mode. An identical key is activated to execute different instructions when the control panel is operated in the first operating mode and the second operating mode.

The above contents of the present invention will become more readily apparent to those ordinarily skilled in the art after reviewing the following detailed description and accompanying drawings, in which:

BRIEF DESCRIPTION OF THE DRAWINGS

FIG. 1(*b*) is a partial enlarged view of the control panel of FIG. 1(*a*);

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention relates to a mode-switching device of a control panel for use in an electronic apparatus such as a fax machine, a telephone, a printer, a scanner, and/or a copy machine, a multifunction peripheral and a remote controller. Nevertheless, the present invention can be applied to other electronic apparatus requesting the mode-switching device.

Figure 1A:
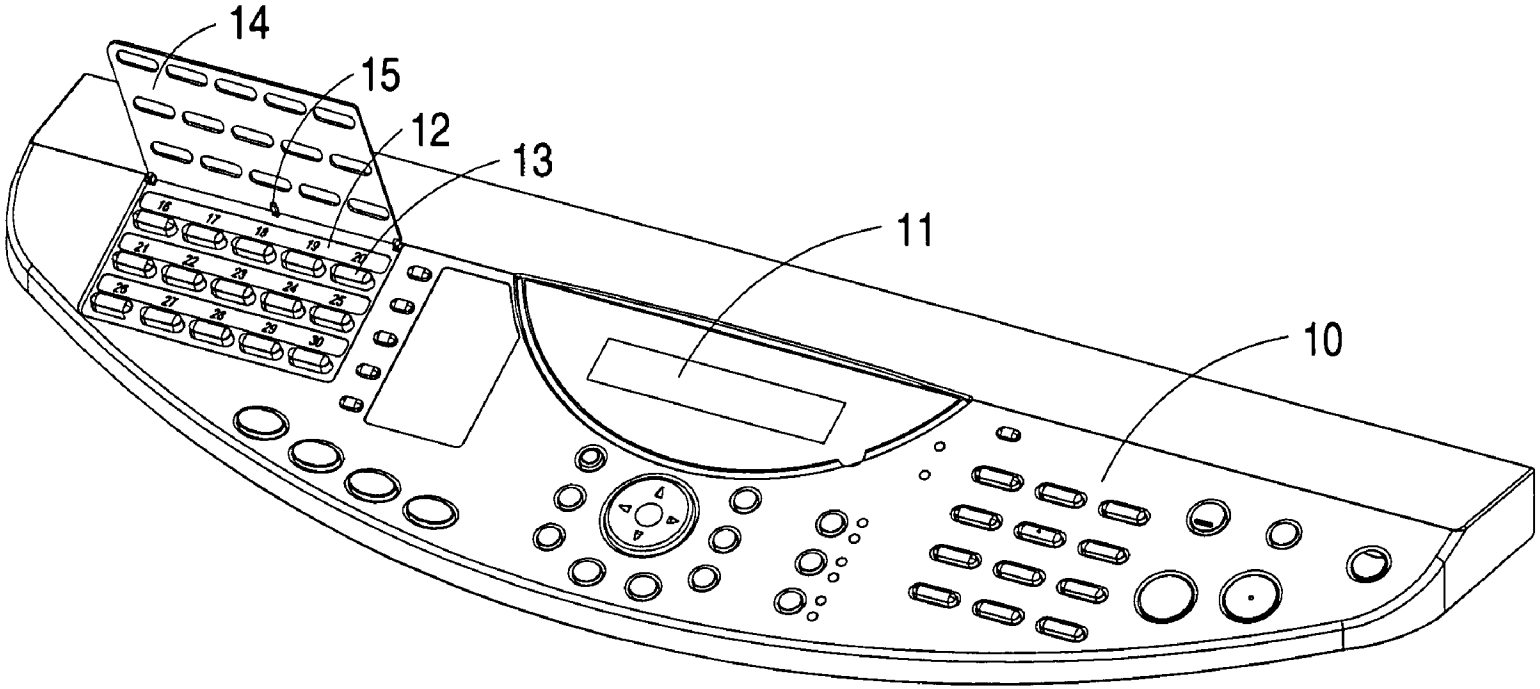
Fig. 1(a) Prior Art
FIG. 1(*a*) is a schematic front view illustrating a conventional control panel for use in an electronic apparatus.
Figure 1B:
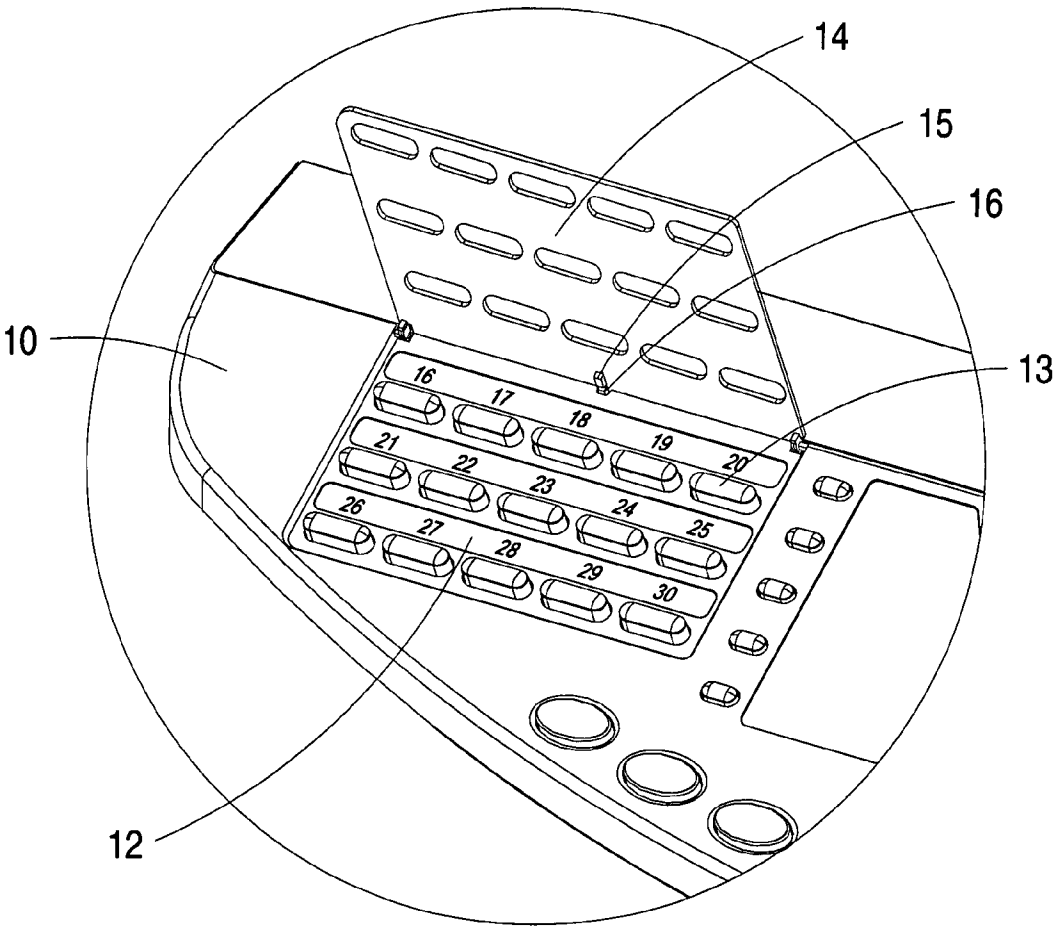
Fig. 1(b) Prior Art
Figure 2A:
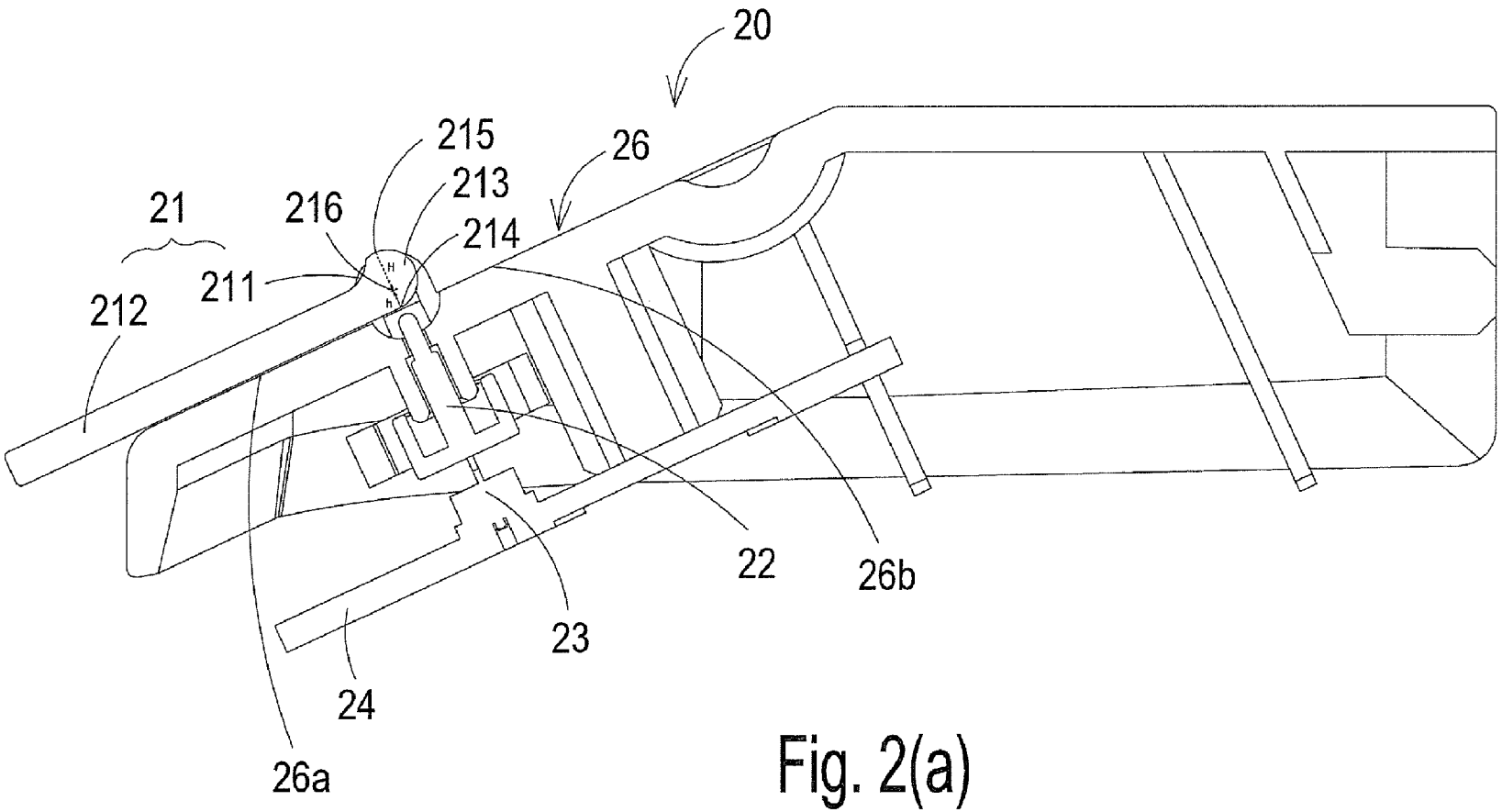
FIGS. 2(*a*)~2(*c*) are schematic cross-sectional views illustrating a mode-switching device operated from a first operating mode to a second operating mode according to a preferred embodiment of the present invention.
Figure 2B:
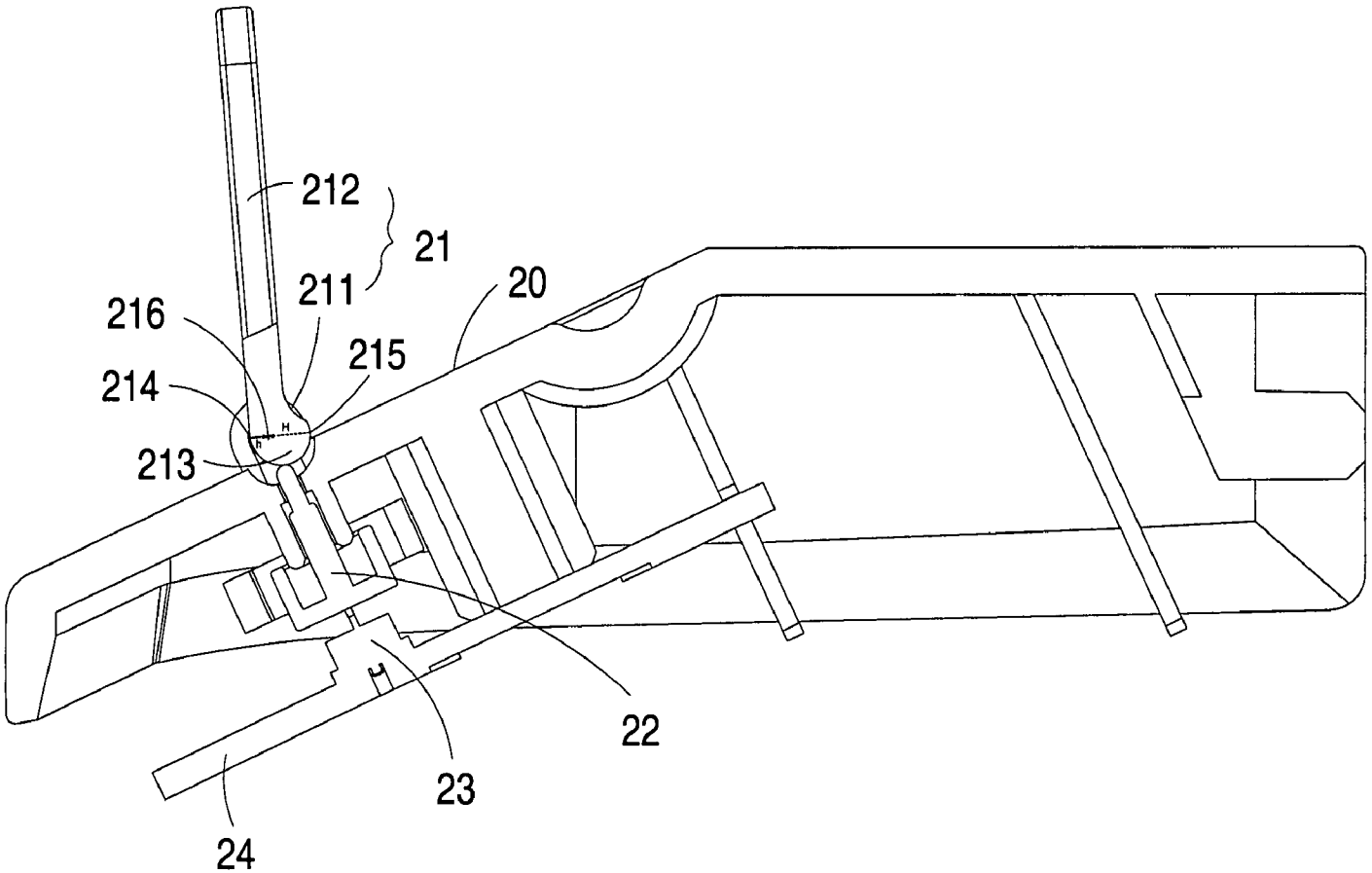
Figure 2C:
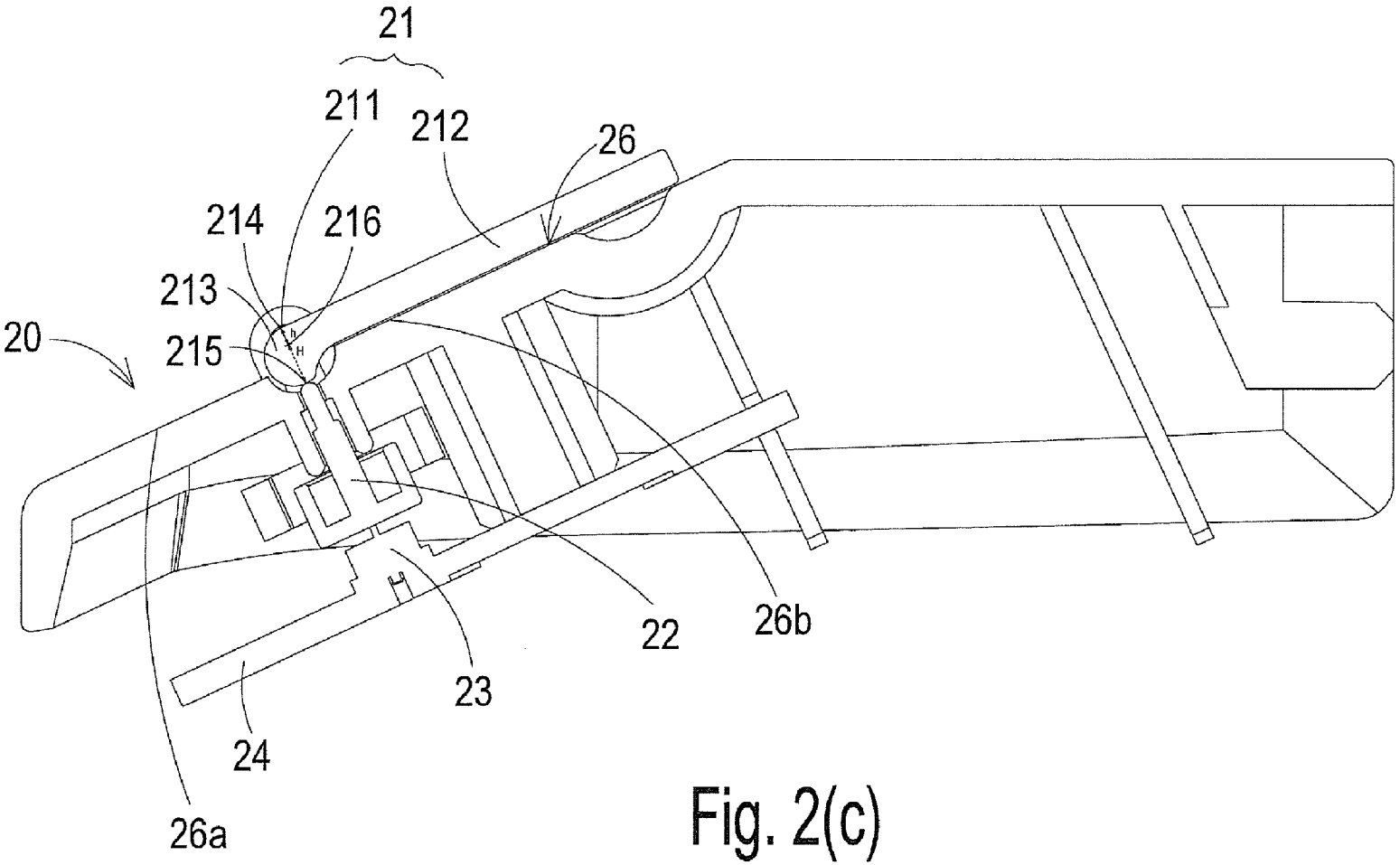

Please refer to FIGS. 2(*a*)~2(*c*), which are schematic cross-sectional views illustrating a mode-switching device operated from a first operating mode to a second operating mode according to a preferred embodiment of the present invention. The mode-switching device includes a foldable plate 21, a triggering element 22 and a switch device 23. The foldable plate 21 includes a rotating shaft 211 and a rotating arm 212. The rotating arm 212 has a cam 213 adjacent to the connecting portion between the rotating shaft 211 and the rotating arm 212. The cam 213 has a first arc surface 214, a second arc surface 215 and a rotating center 216. A first distance h between the first arc surface 214 and the rotating center 216 is less than a second distance H between the second arc surface 215 and the rotating center 216. The triggering element 22 is disposed adjacent to the cam 213. The switch device 23 is disposed on a control circuit board 24 and under the triggering element 22.

As shown in FIG. 2(*a*), the control panel 20 includes a control region 26. When the control panel 20 is operated in the first operating mode, the rotating arm 212 lies flat on a surface of the control panel 20 toward the left side, which is the first area 26*a* of the control region 26. Meanwhile, since the first distance h between the first arc surface 214 and the rotating center 216 is less than the second distance H between the second arc surface 215 and the rotating center 216, the switch device 23 is not in contact with the triggering element 22. When the operating status of the control panel 20 is switched from the first operating mode to the second operating mode, the foldable plate 21 is rotated along the rotating shaft 211 such that the second arc surface 215 of the cam 213 is sustained against the triggering element 22, as is shown in FIG. 2(*b*). The rotating arm 212 is continuously rotated until the rotating arm 212 lies flat on the surface of the control panel 20 toward the right side, which is the second area 26*b* of the control region 26, as is shown in FIG. 2(*c*). Under this circumstance, the triggering element 22 is moved downwardly to activate the switch device 23 thereunder, thereby issuing a control signal. In response to the control signal, the control circuit board 24 will control the operating status of the control panel 20 from the first operating mode to the second operating mode. On the other hand, for switching the operating status of the control panel 20 from the second operating mode to the first operating mode, the foldable plate 21 is rotated along the rotating shaft 211 in a reverse direction such that the second arc surface 215 of the cam 213 is disengaged from the triggering element 22. In response to the restoring force of the resilient element (e.g. a spring) within the triggering element 22 or the switch device 23, the switch device 23 and the triggering element 22 are returned to the original positions as shown in FIG. 2(*a*). Meanwhile, the control panel 20 is switched from the second operating mode to the first operating mode.

Figure 3A:
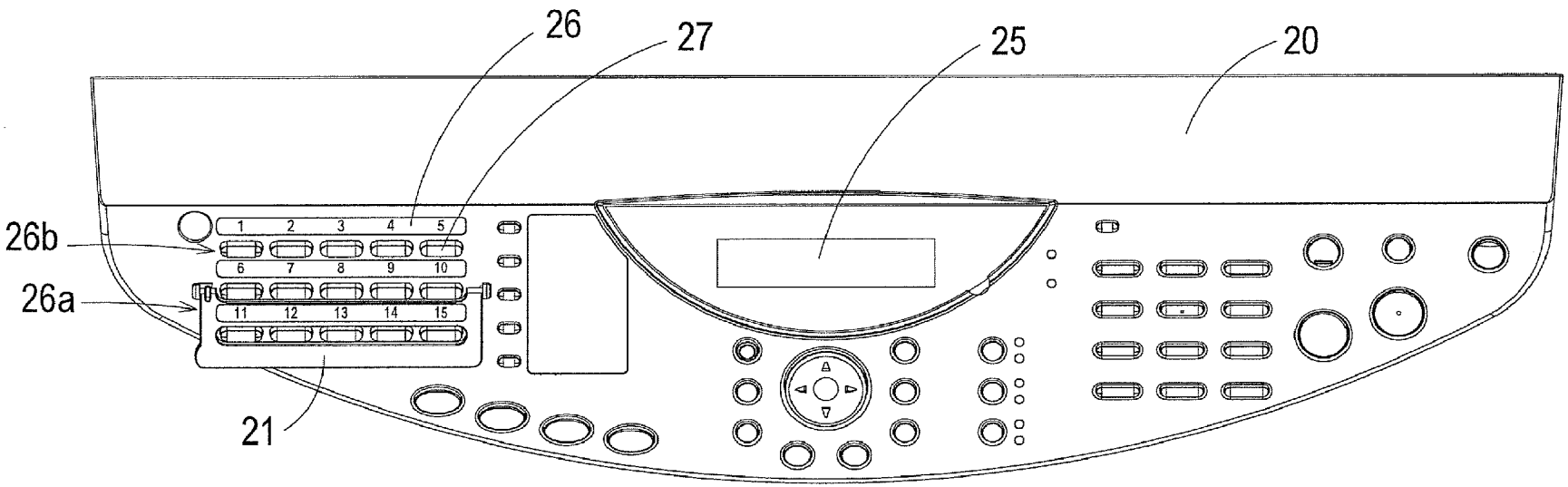
FIGS. 3(*a*) and 3(*b*) are schematic front views illustrating a control panel operated in a first operating mode and a second operating mode, respectively.
Figure 3B:
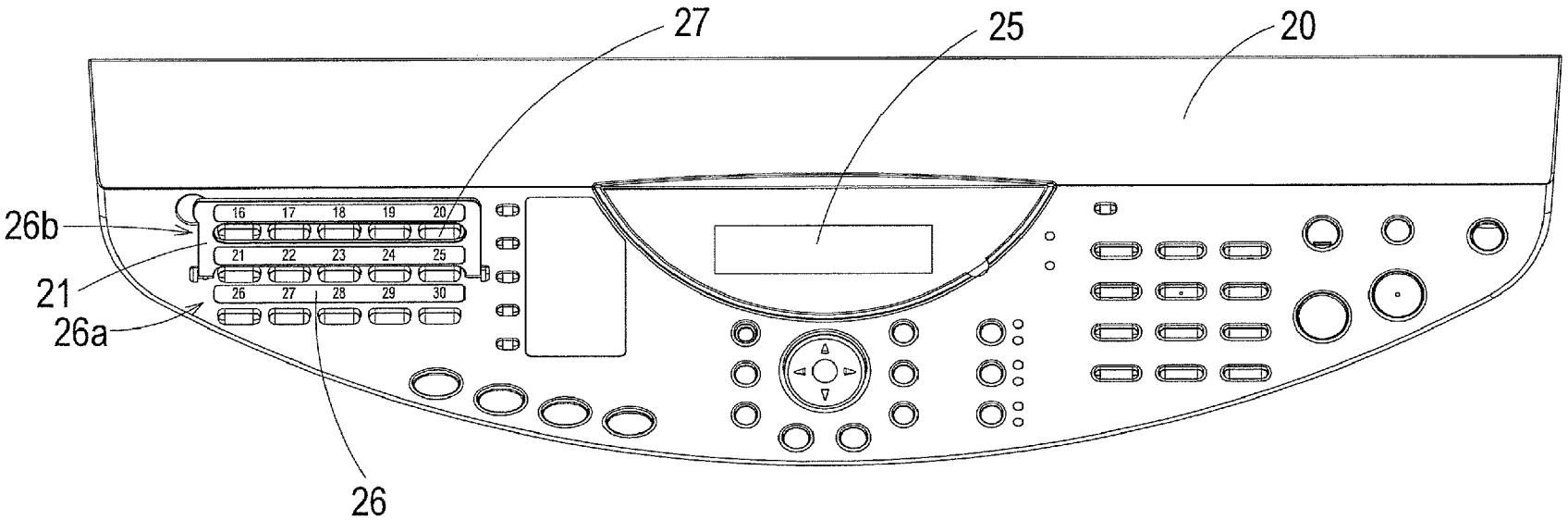

Referring to FIGS. 3(*a*) and 3(*b*), schematic front views of a control panel operated in a first operating mode and a second operating mode are respectively illustrated.

As shown in FIG. 3(*a*), the control panel 20 further includes a display region 25. The operating statuses of the electronic apparatus are shown on the display region 25. The control region 26 comprises fifteen keys 27 activated to execute different instructions. When the control panel 20 is operated in the first operating mode, the fifteen keys 27 can be activated to execute the first to the fifteenth instructions. When the foldable plate 21 is uplifted toward the second area 26*b* of the control region 26, the control panel 20 is operated in the second operating mode, as is shown in FIG. 3(*b*). In the second operating mode, the fifteen keys 27 of the control region 26 are activated to execute the sixteenth to the thirtieth instructions. As a consequence, a constant number of keys contained in the control region 26 can be activated to execute doubled instructions.

In the above embodiments, the first arc surface 214 and the second arc surface 215 of the cam 213 are arc-shaped. When the foldable plate 21 is rotated along the rotating shaft 211, the cam 213 is slowly lowered to touch the triggering element 22. After the triggering element 22 is compressed to some extent, the switch device 23 is activated by the triggering element 22. Since excess compression and full activation are rendered, the stability and reliability of switching the operating modes are enhanced. The cam 213 is an eccentric cam and the shape thereof is not limited to arc shape or other arbitrary shape. An example of the switch device 23 includes but is not limited to a sensor switch for issuing a control signal to the control circuit board 24. Alternatively, the switch device 23 may be enclosed by a plastic ring (not shown) to prevent electrostatic discharge (ESD) and electro-magnetic interference (EMI).

As previously described, the mode-switching device 14 is readily raised up if the weight thereof is not sufficient. In the mode-switching device of the present invention, the foldable plate 21 is rotated along the rotating shaft 211 and the cam 213 adjacent to the connecting portion between the rotating shaft 211 and the rotating arm 212, the foldable plate 21 will lie flat on the surface of the control panel 20 toward the left side, which is the first area 26*a* of the control region 26, or the right side, which is the second area 26*b* of the control region 26, in response to an external force used for rotating the foldable plate 21. Since the foldable plate 21 lies flat on the surface of the control panel 20, the possibility of raising the foldable plate 21 is minimized, and the stability and reliability of switching the operating modes are enhanced. Moreover, the procedures of forming the bump 15 and forming an indentation to accommodating the switch element 16 are omitted according to the present invention. Since the switch element needs not be exposed, the problems of causing electrostatic discharge (ESD) and electro-magnetic interference (EMI) are overcome.

The mode-switching device of present invention is distinguished by using the eccentric cam 213. Since the distance h between the first arc surface 214 and the rotating center 216 is different from the distance H between the second arc surface 215 and the rotating center 216, the eccentric cam 213 is selectively sustained against or disengaged from the triggering element 22 when the foldable plate 21 is rotated. In a case that the second arc surface 215 of the cam 213 is sustained against the triggering element 22, the triggering element 22 is moved downwardly to activate the switch device 23 thereunder, thereby issuing an on signal. In response to the on signal, the control circuit board 24 will control the operating status of the control panel 20 from the first operating mode to the second operating mode. In a case that the foldable plate 21 is rotated along the rotating shaft 211 in a reverse direction, the second arc surface 215 of the cam 213 is disengaged from the triggering element 22. In response to the restoring force of the resilient element within the triggering element 22 or the switch device 23, the switch device 23 is returned to the original position and an off signal is issued. In response to the off signal, the control circuit board 24 will control the operating status of the control panel 20 from the second operating mode to the first operating mode.

From the above description, since the procedures of forming the bump 15 and forming an indentation to accommodating the switch element 16 are omitted, the mode-switching device of present invention is simplified and the appearance of the control panel is more aesthetically pleasing. In addition, since the foldable plate lies flat on the surface of the control panel, the possibility of raising the foldable plate is minimized, and the stability and reliability of switching the operating modes are enhanced. Since the switch element needs not be exposed, the problems of causing electrostatic discharge (ESD) and electro-magnetic interference (EMI) are overcome.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A mode-switching device of a control panel for use in an electronic apparatus, said control panel comprising a control region having a first area and a second area, said mode-switching device being operated to control the operating status of said control panel to be switched between a first operating mode and a second operating mode, said mode-switching device comprising:

a foldable plate disposed above said control panel and arranged on said control region between said first area and said second area, said foldable plate including a rotating shaft and a rotating arm, said rotating arm having a cam adjacent to a connecting portion between said rotating shaft and said rotating arm, said cam having a first arc surface, a second arc surface and a rotating center, wherein a first distance between said first arc surface and said rotating center is less than a second distance between said second arc surface and said rotating center;

a triggering element disposed under said cam and beneath said control panel, said triggering element being partially exposed relative to said control panel; and a switch device disposed on a control circuit board and under said triggering element, wherein said control panel is operated in said first operating mode when said rotating arm of said foldable plate lies on said first area such that said cam is separated from said triggering element, and said foldable plate is rotated along said rotating shaft to cause said rotating arm to lie on said second area such that said second arc surface of said cam is directly sustained against said triggering element to move said triggering element downwardly to activate said switch device, thereby controlling the operating status of said control panel from said first operating mode to said second operating mode.

2. The mode-switching device according to claim 1 wherein said switch device further includes a resilient element.

3. The mode-switching device according to claim 2 wherein said resilient element is a spring.

4. The mode-switching device according to claim 2 wherein said foldable plate is rotated along said rotating shaft in a reverse direction such that said second arc surface of said cam is disengaged from said triggering element, and said switch device is returned to the original position in response to a restoring force of said resilient element, thereby controlling the operating status of said control panel from said second operating mode to said first operating mode.

5. The mode-switching device according to claim 1 wherein said first arc surface of said cam is arc-shaped.

6. The mode-switching device according to claim 1 wherein said second arc surface of said cam is arc-shaped.

7. The mode-switching device according to claim 1 wherein said cam is an eccentric cam.

8. The mode-switching device according to claim 1 wherein said switch device is a sensor switch.

9. The mode-switching device according to claim 1 wherein said switch device is enclosed by a plastic ring.

10. The mode-switching device according to claim 1 wherein said electronic apparatus is a fax machine, a telephone, a printer, a scanner, and/or a copy machine, a multifunction peripheral or a remote controller.

11. A control panel for use in an electronic apparatus, said control panel comprising:

a control region including a plurality of keys, said control region having a first area and a second area, and said plurality of keys being disposed on said first area and said second area;

a display region for showing the operating status of said electronic apparatus thereon; and a mode-switching device comprising a foldable plate, a triggering element and a switch device, said foldable plate being disposed above said control panel and arranged on said control region between said first area and said second area, said foldable plate including a rotating shaft and a rotating arm, said rotating arm having a cam adjacent to a connecting portion between said rotating shaft and said rotating arm, said cam having a first arc surface, a second arc surface and a rotating center, wherein a first distance between said first arc surface and said rotating center is less than a second distance between said second arc surface and said rotating center, said triggering element is disposed under said cam and beneath said control panel, and said triggering element is partially exposed relative to said control panel, and said switch device is disposed on a control circuit board and under said triggering element, wherein said control panel is operated in a first operating mode when said rotating arm of said foldable plate lies on said first area such that said cam is separated from said triggering element, and said foldable plate is rotated along said rotating shaft to cause said rotating arm to lie on said second area such that said second arc surface of said cam is directly sustained against said triggering element to move said triggering element downwardly, thereby controlling the operating status of said control panel from said first operating mode to a second operating mode, wherein an identical key is activated to execute different instructions when said control panel is operated in said first operating mode and said second operating mode.

12. The control panel according to claim 11 wherein said electronic apparatus is a fax machine, a telephone, a printer, a scanner, and/or a copy machine, a multifunction peripheral or a remote controller.

13. The control panel according to claim 11 wherein said switch device further includes a resilient element.

14. The control panel according to claim 11 wherein said foldable plate is rotated along said rotating shaft in a reverse direction such that said second arc surface of said cam is disengaged from said triggering element, and said switch device is returned to the original position in response to a restoring force of said resilient element, thereby controlling the operating status of said control panel from said second operating mode to said first operating mode.

* * * * *